US006459868B1

(12) United States Patent
Takahashi et al.

(10) Patent No.: US 6,459,868 B1
(45) **Date of Patent: *Oct. 1, 2002**

(54) IMAGE FORMING APPARATUS HAVING A PLURALITY OF IMAGE FORMING UNITS WITH POSITIONING FEATURE AND ASSEMBLING METHOD THEREFOR

(75) Inventors: Kazuaki Takahashi, Numazu; Masanori Yamagata, Mishima, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/536,462

(22) Filed: Mar. 28, 2000

(30) Foreign Application Priority Data

Mar. 29, 1999 (JP) ..... 11-085582
Mar. 15, 2000 (JP) ..... 2000-071641

(51) Int. Cl.[7] ..... G03G 21/16; G03G 15/00

(52) U.S. Cl. ..... 399/110; 399/112

(58) Field of Search ..... 399/110, 111, 399/112, 113, 299, 301, 121; 347/115, 116, 138; 29/464, 466, 469

(56) References Cited

U.S. PATENT DOCUMENTS 5,552,857 A * 9/1996 Ishikawa ..... 399/113
5,937,246 A * 8/1999 Kaneyama ..... 399/228
5,953,559 A * 9/1999 Obu ..... 399/110

FOREIGN PATENT DOCUMENTS

JP 9-304994 * 11/1997

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes a plurality of image forming units, each having an image carrier for transferring images of each color to a transfer medium. Each of the image forming units has an exposing device for exposing the image carrier, and wherein the image forming units adjacent to one another are in contact with one another.

35 Claims, 8 Drawing Sheets

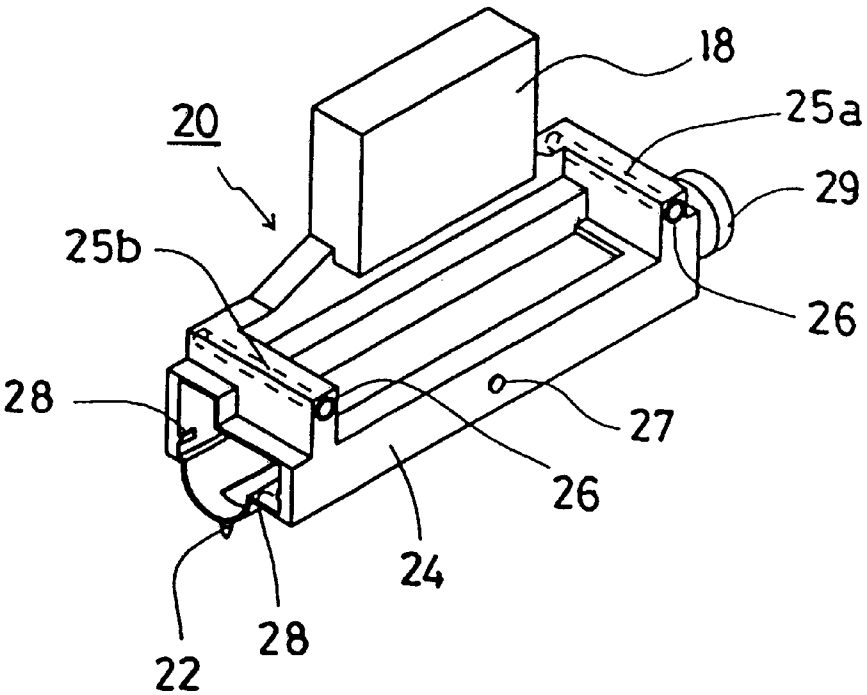
FIG.3
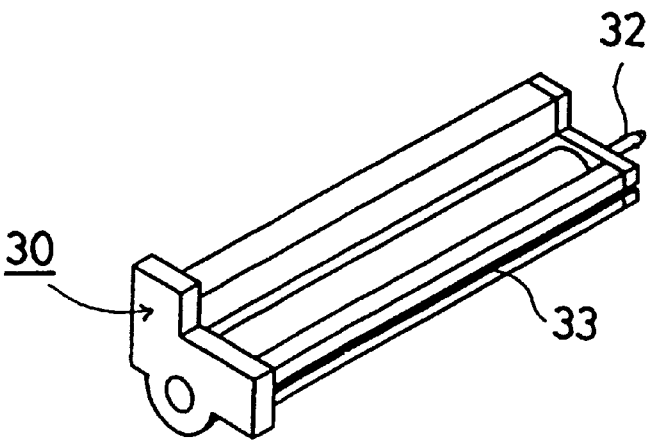

IMAGE FORMING APPARATUS HAVING A PLURALITY OF IMAGE FORMING UNITS WITH POSITIONING FEATURE AND ASSEMBLING METHOD THEREFOR

BACKGROUND OF THE INVENTION

1. Field of the Invention

This invention relates to an image forming apparatus using an electrophotographic system, e.g., a photocopier, a printer, a facsimile machine, or the like, and an assembling method for the image forming apparatus.

2. Description of Related Art

As image forming apparatuses capable of printing multicolor typing such as color photocopiers and color printers, a multiple image forming apparatus as set forth in Japanese Unexamined Patent Publication No. 63-271,275 can be exemplified. Furthermore, in recent years, high speed operation is demanded, and from this context, the embodiments of the image forming apparatus described in the Gazette are frequently used.

In a full color type image forming apparatus having four photosensitive drums, each toner image formed on each photosensitive drum is transferred sequentially onto a transfer medium, so that if a parallel degree between the image forming sections of the respective colors (or a parallel degree in an axial direction of the respective photosensitive drums) is not proper the apparatus suffers color shifts as problems.

To solve these problems, as described in Japanese Unexamined Patent Publication No. 64-84,263, some conventional apparatus had a structure that a face plate individually adjustably mounting adjusting members for supporting other end of the structural members in an axial direction is secured to a body frame located on a front side of the apparatus where one end in the axial direction of the structural members composed of an image carrier, an exposing means, a transfer means, etc. is supported to a securing position of the body frame on a rear side.

However, such a conventional apparatus is adjusted in mounting, to the body frame, the image carrier, the exposing means, the transfer means, etc. respectively serving as the structural members for the image forming means, and therefore, it is difficult to adjust the parallel degree between the structural members such as the image carrier and the like constituting the image forming means, and adjusting the parallel degree takes so much time.

SUMMARY OF THE INVENTION

It is an object of the invention to provide an image forming apparatus capable of easily adjusting mutual parallel degrees among plural image carriers, and mutual parallel degrees among plural exposing means and plural image carriers and capable of preventing color shifts from occurring in the images formed on a transfer medium.

Other objects of the invention become apparent when the following detailed description is read.

BRIEF DESCRIPTION OF THE DRAWINGS

FIG. 3 is an illustration showing an illustration showing a mounting state of a process cartridge to the above monochrome image forming module;

DETAILED DESCRIPTION OF THE PREFERRED EMBODIMENTS

Figure 1:
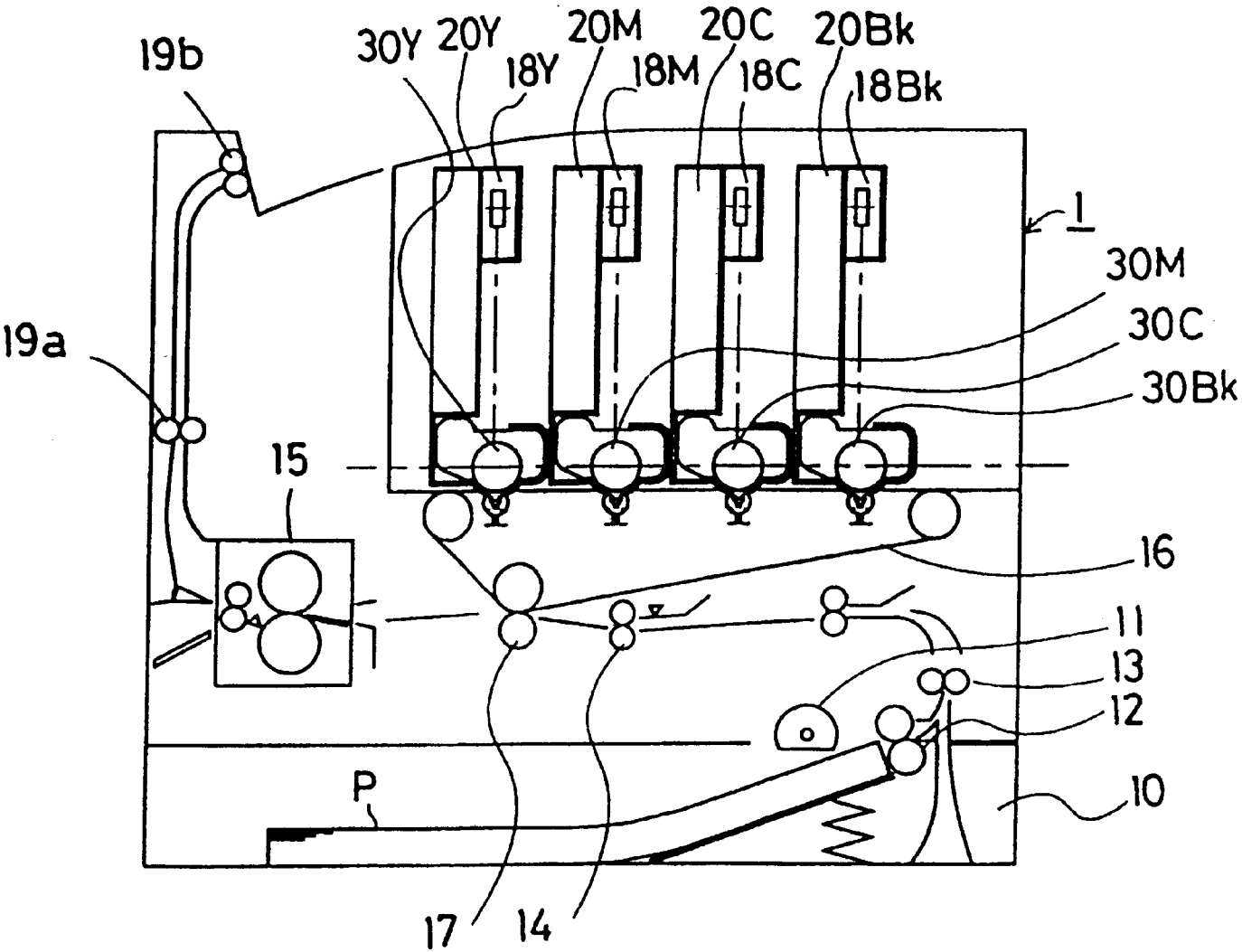
FIG. 1 is a cross-sectional view showing a schematic structure of an image forming apparatus according to a first embodiment of the invention.

Hereinafter, referring to the drawings, an image forming apparatus according to an embodiment of the invention is described in detail. In the following embodiments, electrophotographic image forming apparatuses capable of full color image forming are exemplified.

First Embodiment

Referring to FIGS. 1 to 6, an image forming apparatus according to the first embodiment is described in detail. FIG. 1 is a cross-sectional view showing a schematic structure of a full color image forming apparatus according to the first embodiment. In this embodiment, as shown in FIG. 1, a full color image forming apparatus using four photosensitive members and an intermediate transfer member as a transfer medium is exemplified.

As shown in FIG. 1, the image forming apparatus 1 detachably mounts at a lower portion of the apparatus a cassette 10 to contain and stack recording media or recording sheets P of plural sheets. The recording sheets P contained and stacked in the cassette 10 are fed by a feeding roller 11. The recording sheets P thus conveyed are separated sheet by sheet by means of a retard roller pair 12, and the separated sheet P is conveyed to a register roller pair 14 by a conveyance roller pair 13. When the recording sheet P is conveyed, the register roller pair 14 is stopped from rotating, and the recording sheet P is corrected from proceeding obliquely by hitting this nip.

Process cartridges 30Y, 30M, 30C, 30Bk containing photosensitive drums as image carriers are placed sequentially for colors of yellow, magenta, cyan, and black as shown in FIG. 1 in a case of a four drum full color system. Each of the process cartridges 30Y, 30M, 30C, 30Bk has, in a united body, a photosensitive drum, and as process means operating to the photosensitive drum, a charging means for charging uniformly a surface of the photosensitive drum, a developing means for developing, with toners, latent images formed on the photosensitive drum, and a cleaning means for removing remaining developing agents or the like on the photosensitive drum after transfer, not shown. Each of the process cartridges 30Y, 30M, 30C, 30Bk is contained detachably in each of monochrome image forming modules 20Y, 20M, 30C, 20Bk as image forming units. The photosensitive drum in the respective process cartridges 30Y, 30M, 30C, 30Bk is driven by a drive motor mounted in the monochrome image forming modules 20Y, 20M, 30C, 20Bk, respectively, as described in detail below. At the same time, a toner image is formed on the respective photosensitive drum according to the image signal, and the toner image of each color formed on the respective photosensitive drum is sequentially transferred onto an intermediate transfer belt 16.

Thereafter, the toner image on the intermediate transfer belt 16 is transferred by a secondary transfer roller 17 to the recording sheet P sent by the register roller pair 14 at a predetermined timing. The recording sheet P to which the toner image is transferred is delivered and stacked by delivery roller pair 19*a*, 19*b* after the toner image is fixed by a fixing unit 15.

Figure 2:
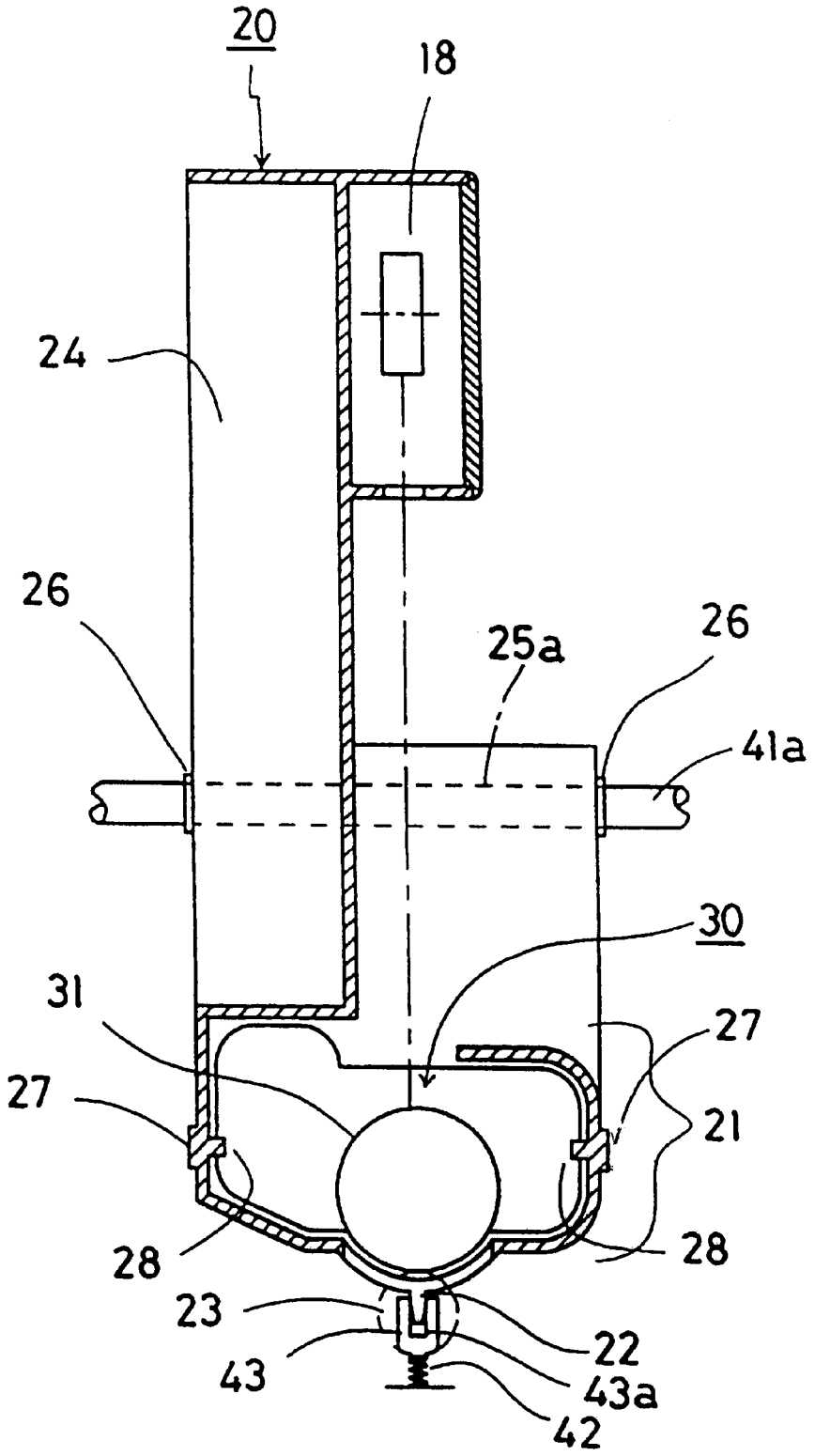
FIG. 2 is a detailed view showing a monochrome image forming module in the above image forming apparatus.

A schematic structure of the monochrome image forming module is described next. FIG. 2 is a cross-section showing a schematic structure of the monochrome image forming module.

As shown in FIG. 2, in the monochrome image forming module 20, a laser scanner unit 18 as exposing means for exposing the photosensitive drum 31 according image information (18Y, 18M, 18C, 18Bk in FIG. 1), a guide portion 21 for holding the process cartridge 30 containing a respective photosensitive drum 31, a positioning member 22 for a transfer roller 23 as a transfer means facing to the photosensitive drum 31, and a drive motor 29 (see, FIG. 3) formed on a rear side and side surface of the guide portion 21 for driving the photosensitive drum 31 are formed in a single housing 24. In the housing 24, through holes 25*a*, 25*b* are placed at two portions in the opposite ends in a longitudinal direction of the housing, and coupling shafts 41*a*, 41*b* (see, FIG. 4), which are used when the plural monochrome image forming modules 20 are coupled in a line, are penetrated into the through holes 25*a*, 25*b*. A hitting portion 26 is formed at each edge of the holes 25*a*, 26*a*. Each hitting portion 27 is formed at two portions in the horizontal direction with respect to the photosensitive drum 31 around a center in the longitudinal direction of the photosensitive drum 31 as shown in FIG. 2 and FIG. 3.

The process cartridge 30 is engaged as shown in FIG. 3 detachably with the monochrome image forming module 20. The process cartridge 30 including the photosensitive drum 31 is driven by coupling a shaft end coupling portion 32 of the photosensitive drum 31 with an opponent member, not shown, engaging with the coupling portion 32. Positioning of the process cartridge 30 is determined, on the rear side of the apparatus, by engagement between the shaft end coupling portion 32 of the photosensitive drum 31 and the opponent member, not shown, and determined, on the front side of the apparatus, by fitting a projection 28 formed on the side of the housing 24 into a recess groove 33 formed on the side of the process cartridge 30.

With the image forming apparatus according to this embodiment, the intermediate transfer belt 16 is used, and the transfer roller 23 is used as a primary transfer means for transferring to the intermediate transfer belt 16 the images (toner images) formed on the photosensitive drum 31. This transfer roller 23 is urged to the photosensitive drum 31 via the intermediate transfer belt 16 by means of a spring 42 as an urging means with a prescribed pressure. A parallel degree is necessary, as a matter of course, for the rotary shaft of the transfer roller 23 and the rotary shaft of the photosensitive drum 31, but as shown in FIG. 2, the positioning member 22 is formed on a lower surface on the opposite ends in the longitudinal direction of the respective monochrome image forming module 20 to fit into a recess groove 43*a* of each holder pair 43 for rotatively holding the respective transfer rollers 23. Therefore, with this structure, color shifts caused by transfer position shifts (shifts in mutual position of the transfer roller with respect to the photosensitive drum) can be prevented.

Figure 4:
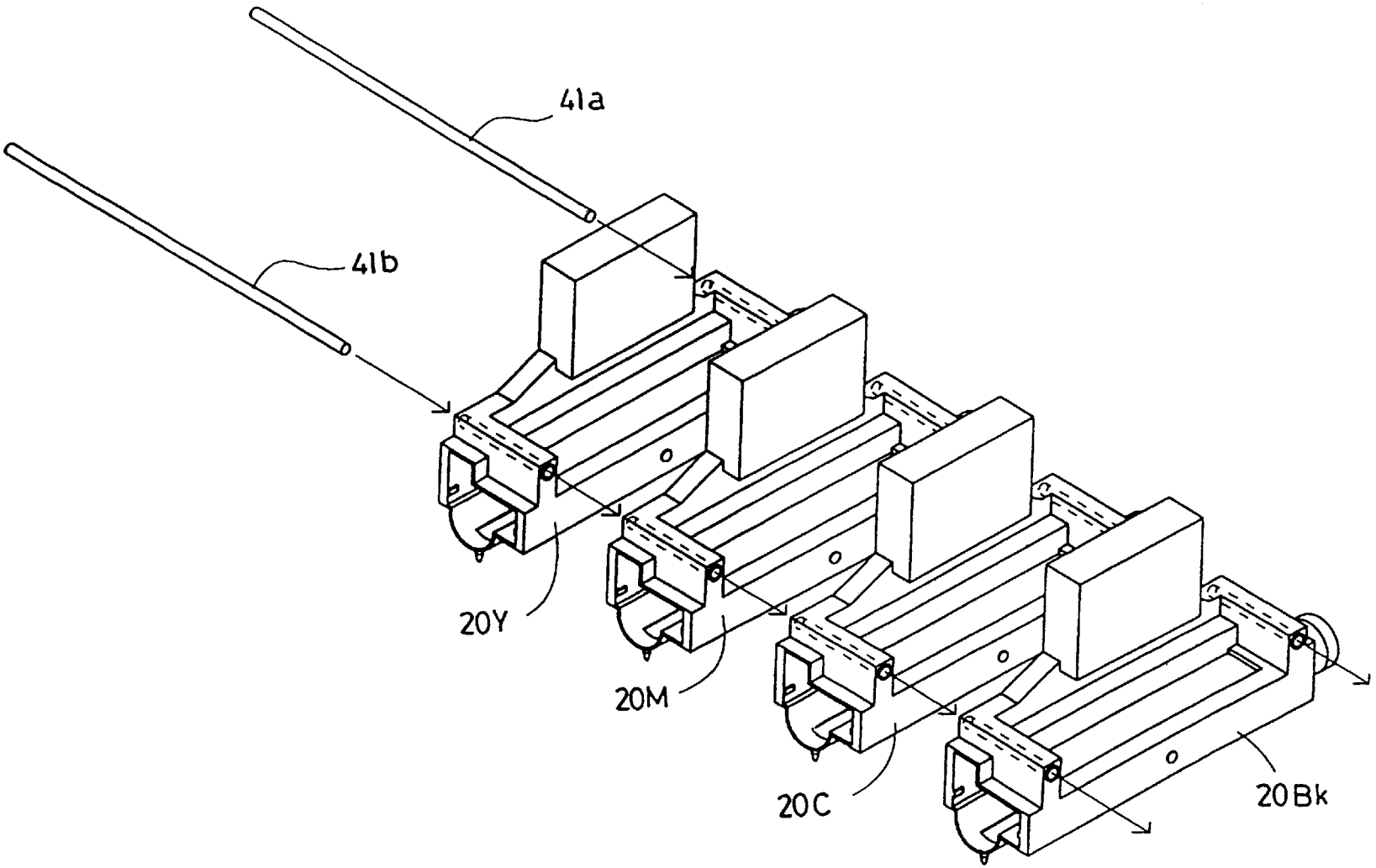
FIG. 4 is an illustration showing a coupling of the above monochrome image forming module.
Figure 5:
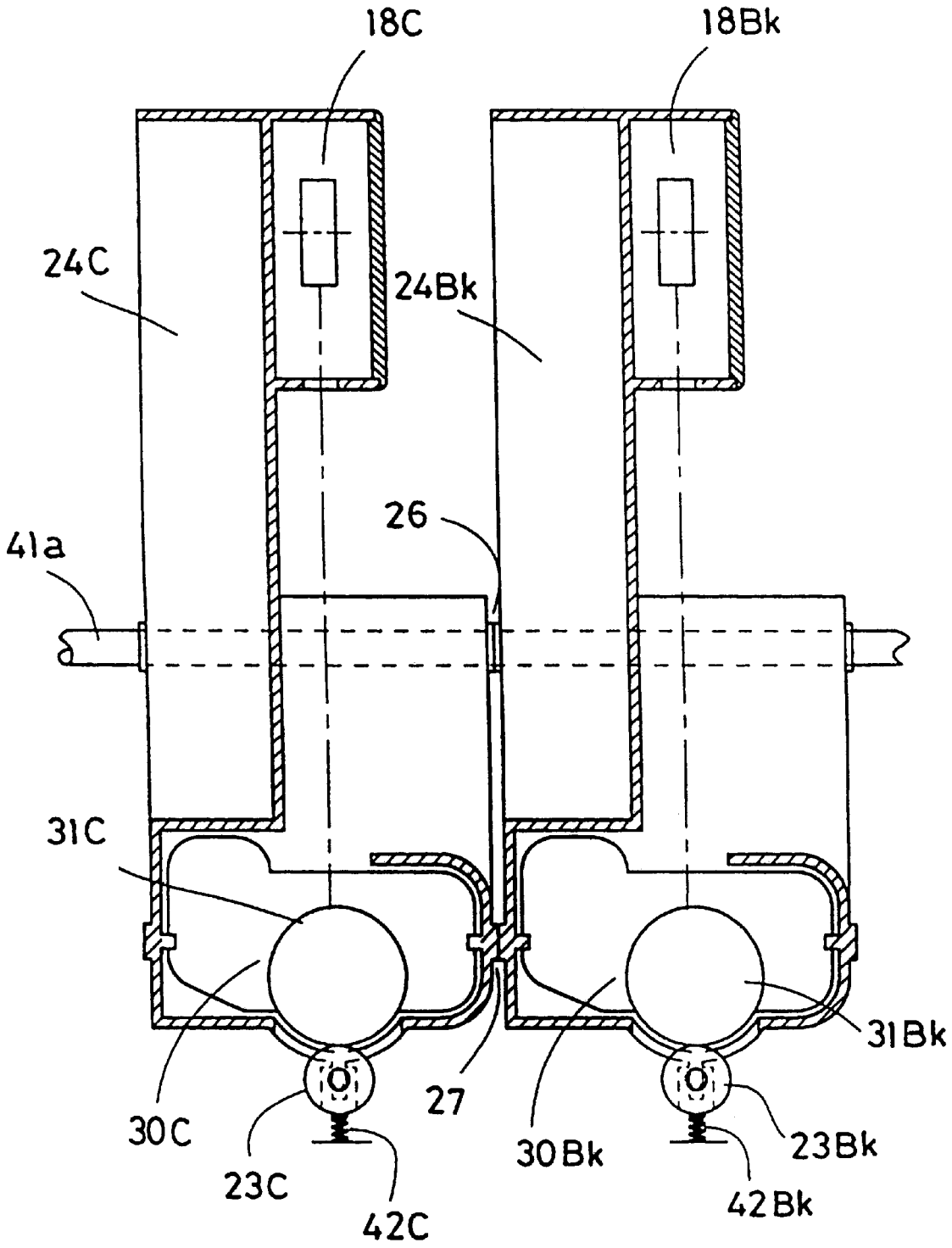
FIG. 5 is an illustration showing a coupling of the above monochrome image forming module.
Figure 6:
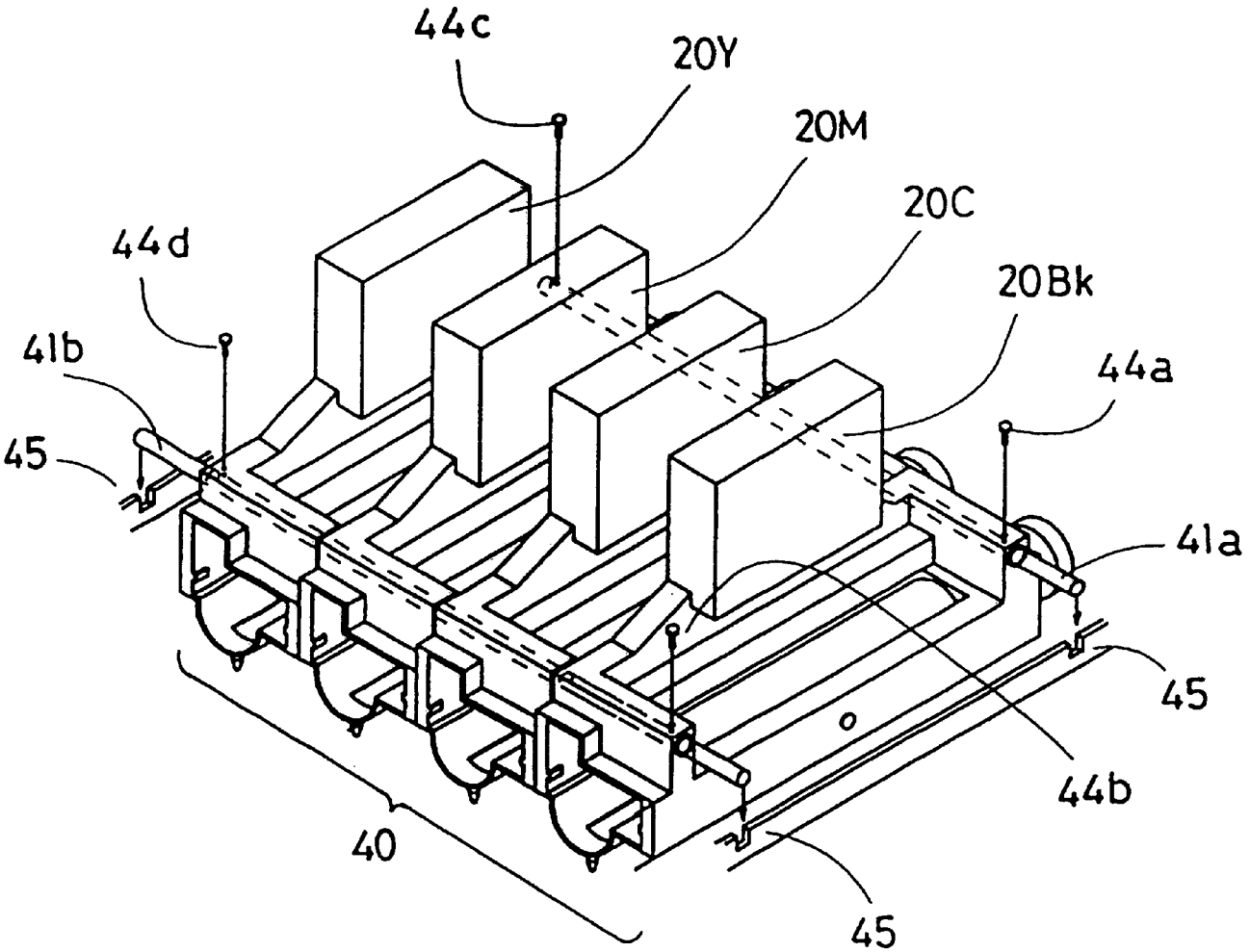
FIG. 6 is an illustration showing a multicolor image forming module constituted of the above coupled monochrome image forming modules.

A multicolor image forming module 40 can be made by aligning the above monochrome image forming modules 20Y, 20M, 20C, 20Bk as shown in FIGS. 4 to 6 and coupling the modules with each other by closely contacting the hitting portions 26, 27 to one another by the two connection shafts 41*a*, 41*b* and finally securing the modules with securing bolts 44*a*, 44*b*, 44*c*, 44*d*. Where the multicolor image forming module 40 is fitted into a recess groove 45 of the body frame and positioned thereat, a full color image forming apparatus can be assembled easily.

In addition to the above structure, a U-shaped portion may be formed in directing a lower side in the opposite ends in the longitudinal direction of the respective image forming modules, and the modules may be secured by engaging the U-shaped portion pair with the connection shafts 41*a*, 41*b* and fastening the modules with bolts. In such a case, the image forming modules 20M, 20C also can be taken out easily from the apparatus body, so that usability of the apparatus can be improved.

The apparatus thus structured can easily guarantee the positions (parallel degrees and the like) of the respective photosensitive drums because all of the structural members constituting the image forming means such as the process cartridge, the laser scanner, and the like, including the photosensitive drums necessary for image formation, are integrated in a single housing. This apparatus also can easily guarantee radiation positional accuracy to the shafts of the respective photosensitive drums (or make unnecessary adjustments of radiation points) because the radiation point of the laser scanner for forming latent images on the respective photosensitive drums can exist on the same housing, and in other words, the laser scanning line can be set substantially parallel to the basic lines of the photosensitive drums. That is, even if the laser scanning line is inclined to the basic line of the respective photosensitive drum, the scanning line would indicate an inclining tendency in the same way among the respective image forming modules which are assembled in the same production line and with the same manufacturing steps, so that a phenomenon such as color shifts can be suppressed.

A distance between centers of the photosensitive drums in the monochrome image forming modules adjacent to each other, or distance between transfer positions can be guaranteed with accuracy of the parts of the housing itself, so that the apparatus can prevent color shifts from occurring in images formed on the intermediate transfer belt.

The respective transfer rollers facing to the respective photosensitive drums, giving the primary transfer positions, can receive the benefits in positional guarantee (accuracy in each member) in the respective monochrome image forming modules, so that the apparatus can prevent color shifts from occurring due to positional shifts of transfer.

With the above full color image forming apparatus using a plurality of the monochrome image forming modules, all members including the process cartridge are commonly structured and can be assembled with the same assembling steps, so that management can be made very easily and a reduced cost can be expected from mass-production.

Second Embodiment

Figure 7:
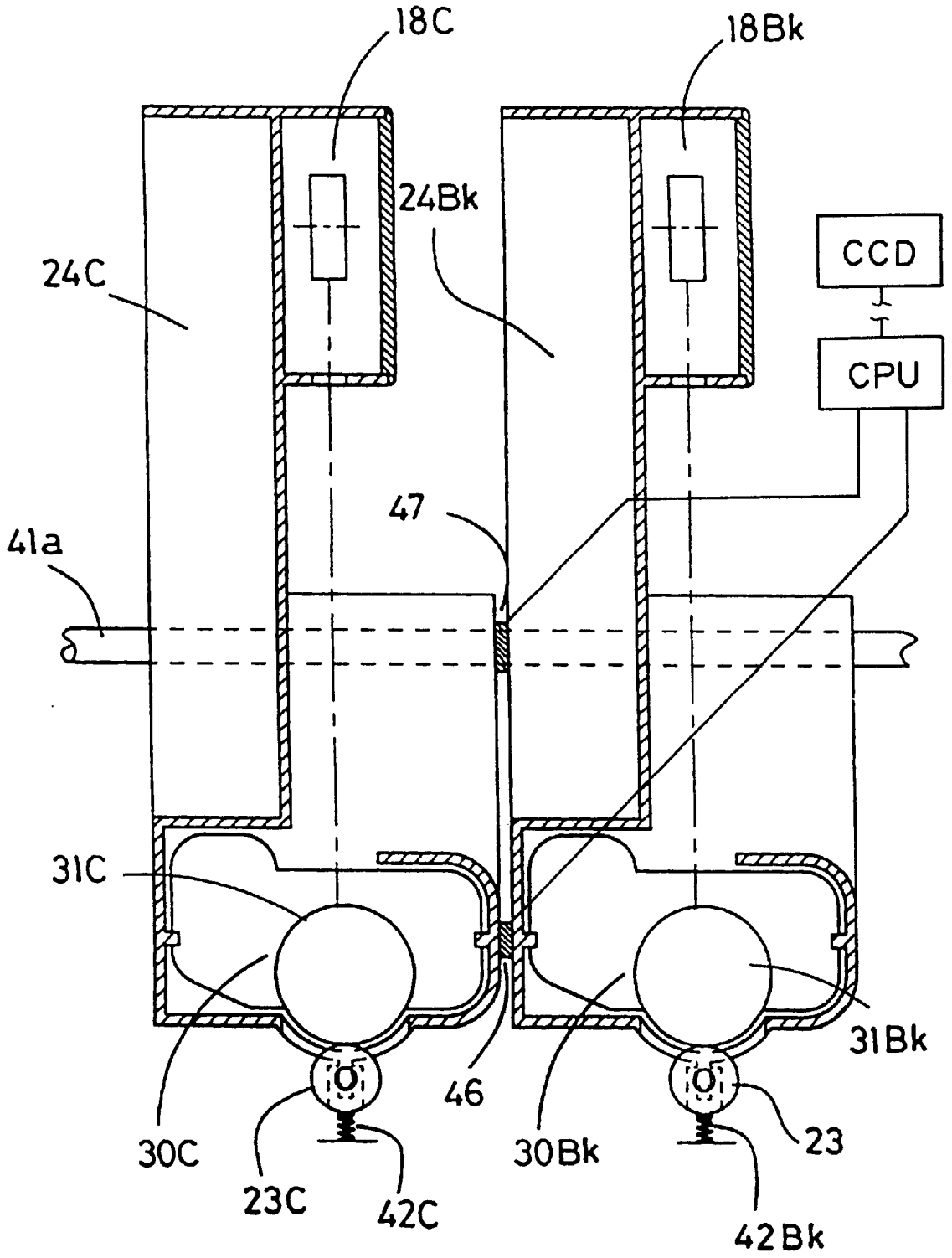
FIG. 7 is an illustration showing a coupling of the above monochrome image forming module according to a second embodiment of the invention.

Referring to FIG. 7, an image forming apparatus according to the second embodiment is described. FIG. 7 is a cross-sectional illustration schematically showing monochrome image forming modules in a full color image forming apparatus according to the second embodiment. The structural outline of the whole apparatus is substantially the same as the apparatus described above, and a detailed description is omitted in providing the same reference numbers to members having the equivalent functions.

As shown in FIG. 7, in this embodiment, piezoelectric devices 46, 47 serving as interval adjusting means are formed among the monochrome image forming modules 20 coupled in a line for adjusting interval sizes and are secured by adherence to prescribed positions of the housing 24. When a predetermined voltage is given to those piezoelectric devices 46, 47, the distances between centers of the photosensitive drums can be adjusted finely. The piezoelectric devices, provided thus in the number of two in a vertical direction in FIG. 7, can make the inclination of the respective image forming modules adjustable finely.

For example, even when the parallel degree of the rotary shaft of the respective photosensitive drum 31 is deviated due to stresses of the housing 24 from temperature changes, the parallel degree of the shaft of the respective photosensitive drum 31 can easily be made proper by correcting the intervals among the monochrome image forming modules 20 by application of the prescribed voltage to the piezoelectric devices 46, 47, and the apparatus can prevent color shifts from occurring. To detect the parallel degree, a method is used in which a toner image (register mark) for detection of each color is formed on the intermediate transfer belt 16 from the respective photosensitive drums and in which the position of the register mark is read by a CCD or the like as a detecting means to detect the positional shift amount of the register mark of each color. Based on the detected results, the CPU (controller) as a control means adjusts the respective intervals to prevent the color shifts from occurring.

With this embodiment, the piezoelectric devices are used as an interval adjusting means, but the invention is not limited to those. The same effects can be expected in an adjusting mechanism used for a stepping motor or the like.

The multicolor image forming module 40 is secured to the coupling shafts 41*a*, 41*b* in use of securing bolts 44*a*, 44*b* on one side and not use of securing bolts 44*c*, 44*d* on the other side as shown in FIG. 6. It is to be noted that the module 20R is urged toward the module 20M by a spring or the like.

Where the piezoelectric devices 46, 47 are not adhered to the respective monochrome image forming modules 20, the respective monochrome image forming modules 20 are structured to be always in close contact with the piezoelectric devices 46, 47 by urging the modules 20 on the opposite ends from the outer side to the inner side with a spring or the like.

Other Embodiments

In the above embodiments, the four monochrome image forming modules are used for the multicolor image forming module, but the number to be used is not limited to this, and the number can be set according to necessity.

In the above embodiments, the laser scanner is used for exposing means but the invention is not limited to this. For example, an LED array can be used.

In the above embodiments, as a process cartridge detachably attached to the image forming module, the process cartridge having in a united body the photosensitive drum, and the charging means, the developing means, and the cleaning means as processing means is exemplified, but this invention is not limited to this. The process cartridge can be one having any one of the charging means, the developing means, and the cleaning means in addition to the photosensitive drum.

According to the above embodiments, a structure in which the process cartridge including the photosensitive drum is attached detachably to the image forming module is exemplified, but the invention is not limited to this. For example, the invention can have an image forming module in which respective structural members are assembled or an image forming module in which the structural members are detachable respectively.

Figure 8:
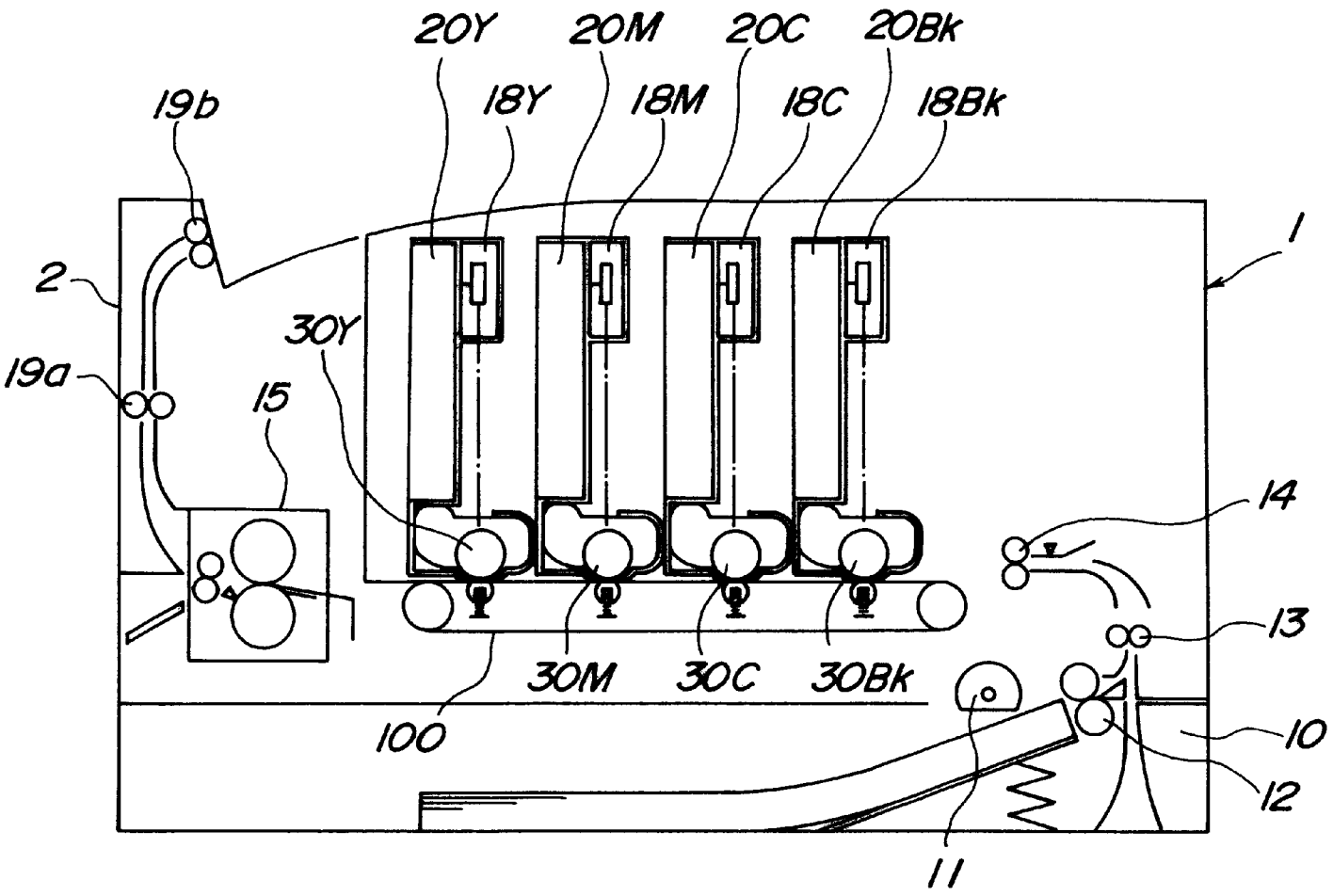
FIG. 8 is an illustration showing another image forming apparatus according to the invention.

With the above embodiments, the printer is exemplified as an image forming apparatus, but the invention is not limited to this, and for example, other image forming apparatuses such as photocopiers, facsimile machines, and the like, or an image forming apparatus in which toner images of each color are sequentially transferred in an overlapping manner onto a transfer medium carried by the transfer conveyance belt 100 as a transfer medium carrier as shown in FIG. 8, can be used. The same effects can be obtained when the invention applies to such an image forming apparatus.

What is claimed is:

1. An image forming apparatus comprising:

a plurality of image forming units, each having an image carrier for transferring images of each color to a transfer medium, wherein each of said image forming units includes an exposing means for exposing said image carrier, and wherein, a common supporting member supports said image forming units, and said image forming units adjacent to one another are in contact with one another.

2. An image forming apparatus according to claim 1, wherein each of said image forming units comprises an image carrier unit detachably attached to said image forming unit.

3. An image forming apparatus according to claim 2, wherein said image carrier unit comprises at least one of a charging means for charging said image carrier unit, a developing means for developing, with toners, latent images formed on said image carrier by said charging means and the exposing means, and a cleaning means for cleaning the toners on said image carrier.

4. An image forming apparatus according to claim 1, wherein said common supporting member is provided in a plural number.

5. An image forming apparatus according to claim 4, wherein said supporting member is a support shaft, and wherein said respective image forming unit has a through hole for receiving said support shaft.

6. An image forming apparatus according to claim 4, wherein respective ones of said image forming units supported by said supporting member are positioned at a positioning portion formed at an apparatus body.

7. An image forming apparatus according to claim 1, wherein respective ones of said image forming units are positioned at a positioning portion formed in an apparatus body.

8. An image forming apparatus comprising:

a plurality of image forming units, each having an image carrier for transferring images of each color to a transfer medium, wherein each of said image forming units includes an exposing means for exposing said image carrier, wherein said image forming units adjacent to one another are in contact with one another, and wherein said image forming apparatus includes a plurality of transferring means for transferring, to the transfer medium, a toner image formed on respective ones of said image carriers, and wherein a respective one of said transferring means is positioned by fitting a restricting member of a respective one of said image forming units to a respective positioning portion formed on said respective one of said transferring means.

9. An image forming apparatus according to claim 8, wherein the toner images of multicolor sequentially transferred to the transfer medium from a respective one of said image carrier are transferred to a recording material.

10. An image forming apparatus according to claim 8, wherein said image forming apparatus includes a transfer medium carrier conveying the transfer medium in carrying the medium to transfer the images in an overlapping manner sequentially on said respective images carriers onto the transfer medium.

11. An image forming apparatus according to claim 8, wherein said restricting member restricts a position of said transferring means in a moving direction of the transfer medium.

12. An image forming apparatus according to any one of claims 1–3 4, or 8, and further comprising an adjusting means for adjusting a distance between respective ones of said image forming units located adjacent to each other.

13. An image forming apparatus according to claim 12, wherein said adjusting means is provided in a plural number in a direction perpendicular to a rotary shaft direction of said image carrier.

14. An image forming apparatus according to claim 12, wherein said adjusting means includes a piezoelectric device, to which a prescribed voltage is fed in order to adjust the distance.

15. An image forming apparatus according to claim 14, wherein the image forming apparatus includes a controlling means for controlling an adjusting amount of the distance by said adjusting means.

16. An image forming apparatus according to claim 15, further comprising detecting means for detecting toner images for detection transferred from respective ones of said image carrier to the transfer medium and said adjusting means controls the adjusting amount of the distance base on detected results by said detecting means.

17. An image forming apparatus according to claim 16, wherein said controlling means controls the adjusting amount of the distance based on positional shifts of the toner images for detection with respect to the positions of other toner images for detection.

18. An image forming apparatus comprising:

a plurality of image forming units, each having an image carrier; and an adjusting means for adjusting a distance between respective ones of said image forming units adjacent to each other, wherein images on respective ones of said image carrier are sequentially transferred in an overlapping manner, and wherein respective ones of said image forming units adjacent to each other are in contact with each other.

19. An image forming apparatus according to claim 18, wherein said adjusting means is provided in a plural number in a direction perpendicular to a rotary shaft direction of said image carrier.

20. An image forming apparatus according to claim 18, wherein said adjusting means comprises a piezoelectric device, to which a prescribed voltage is fed in order to adjust the distance.

21. An image forming apparatus according to any one of claims 18 to 20, wherein the image forming apparatus has a controlling means for controlling an adjusting amount of the distance by said adjusting means.

22. An image forming apparatus according to claim 21, wherein said image forming apparatus including a detecting means for detecting toner images for detection transferred from respective ones of said image carrier to the transfer medium and said adjusting means controls the adjusting amount of the above on detected results by said detecting means.

23. An image forming apparatus according to claim 22, wherein said controlling means controls the adjusting amount of the distance based on positional shifts of the toner images for detection with respect to the positions of other toner images for detection.

24. An image forming apparatus according to claim 18, wherein said image forming apparatus has a supporting member for supporting respective ones of said image forming units.

25. An image forming apparatus according to claim 24, wherein said supporting member is provided in a plural number.

26. An image forming apparatus according to claim 24 or 25, wherein said supporting member is a support shaft, and wherein said respective ones of said image forming units has a though hole for receiving said support shaft.

27. An image forming apparatus according to claim 24 or 26, wherein respective ones of said image forming units supported by said supporting member are positioned at a positioning portion formed at an apparatus body.

28. An image forming apparatus according to claim 18, wherein respective ones of said image forming units are positioned at a positioning portion formed in an apparatus body.

29. An assembling method for assembling in an apparatus body a plurality of image forming units each of which has an image carrier comprising the steps of:

supporting the respective image forming units to a common supporting member to contact the respective image forming unit with each other; and positioning the respective image forming units supported by the supporting member to positioning portions on the apparatus body.

30. An assembling method according to claim 29, wherein the supporting member is provided in a plural number and respective ones of the image forming units are supported by plural supporting members.

31. An assembling method according to claim 29 or claim 30, wherein the supporting member is a support shaft, and wherein respective ones of the image forming unit has a through hole for receiving the support shaft.

32. An image forming apparatus comprising:

a plurality of image forming units, each having an image carrier;

a common supporting member for supporting said image forming units;

wherein said image forming units adjacent to one another are in contact with one another.

33. An image forming apparatus according to claim 32, wherein each of said image forming units includes an exposing means for exposing said image carrier.

34. An image forming apparatus comprising:

a plurality of image forming units, each having an image carrier;

a plurality of transferring means for transferring to a transfer medium, a toner image formed on respective ones of said image carriers;

wherein said image forming units adjacent to one another are in contact with one another, wherein each of said image forming units includes a restricting member, and wherein a respective one of said transferring means is positioned by fitting said restricting member of a respective one of said image forming units to a respective positioning portion formed on said respective one of said transferring means.

35. An image forming apparatus according to claim 34, wherein each of said image forming units includes an exposing means for exposing said image carrier.

* * * * *

UNITED STATES PATENT AND TRADEMARK OFFICE

CERTIFICATE OF CORRECTION

PATENT NO. : 6,459,868 B1
DATED : October 1, 2002
INVENTOR(S) : Kazuaki Takahashi et al.

It is certified that error appears in the above-identified patent and that said Letters Patent is hereby corrected as shown below:

Column 1,
Line 65, “an illustration” (second occurrence) should be deleted.

Column 5,
Line 34, “in use of” should read -- by --; and
Line 35, “not use of” should read -- by --.

Column 7,
Line 10, “claim 1-3 4, or 8,” should read -- claims 1 or 8, --.

Column 8,
Line 12, “though” should read -- through --; and
Line 14, “26,” should read -- 25, --.

Signed and Sealed this

Eighth Day of April, 2003

JAMES E. ROGAN
*Director of the United States Patent and Trademark Office*